US006126144A

United States Patent [19]

Hirsch et al.

[11] Patent Number: 6,126,144

[45] **Date of Patent: *Oct. 3, 2000**

[54] BARREL CRASH CUSHIONS

[75] Inventors: Teddy J. Hirsch, College Station; Don L. Ivey, Bryan, both of Tex.

[73] Assignee: The Texas A&M University System, College Station, Tex.

[ * ] Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 15 days.

[21] Appl. No.: 08/804,284

[22] Filed: Mar. 3, 1997

[51] Int. Cl.[7] ..... A01K 3/00

[52] U.S. Cl. ..... 256/13.1; 256/1; 404/6

[58] Field of Search ..... 256/1, 13.1; 404/6, 404/11

[56] References Cited

U.S. PATENT DOCUMENTS

| | | | |
|---|---|---|---|
| 3,503,600 | 3/1970 | Rich | 256/13.1 X |
| 3,643,924 | 2/1972 | Fitch | 256/13.1 |
| 3,680,662 | 8/1972 | Walker et al. | 256/13.1 X |
| 3,845,936 | 11/1974 | Boedecker, Jr. | 256/13.1 |
| 4,073,482 | 2/1978 | Seegmiller | 256/13.1 X |
| 4,200,310 | 4/1980 | Carney, III | 280/784 |
| 4,289,419 | 9/1981 | Young et al. | 256/13.1 X |

(List continued on next page.)

FOREIGN PATENT DOCUMENTS

| | | | |
|---|---|---|---|
| 149561 | 7/1985 | France | 256/13.1 |

OTHER PUBLICATIONS

National Cooperative Highway Research Program, Report 350; *Recommended Procedures for the Safety Performance Evaluation of Highway Features; National Academy Press;* (1993) (23 p.).

*Primary Examiner*—Bruce A. Lev

*Attorney, Agent, or Firm*—Shawn Hunter; James E. Bradley; Felsman, Bradley, Vaden, Gunter & Dillon, L.L.P.

[57] ABSTRACT

Apparatus and methods are described relating to barrel crash cushions which readily collapse when impacted from a substantially end-on direction, and are more capable than conventional designs of substantially redirecting vehicles impacting from non-end-on directions and reducing the chance of these vehicles tearing through the crash cushion. The described configurations also substantially reduce the harm associated with "coffin corner" impacts through a structurally reinforced portion that increases the ability of the barrel cushion to withstand impacts from directions other than substantially end-on.

In some exemplary embodiments, the structural reinforcement is provided by a telescoping bracket assembly which surrounds some of the barrels of the crash cushion. In another embodiment, the reinforcement is provided by a plurality of interconnected cable sleeves which are carried on cables disposed along the longitudinal sides of the crash cushion to form a linear brace. In still other embodiments, a cushion is constructed using barrels having differing resistances to crushing. The barrels having the greatest resistance are placed along the longitudinal sides close to the fixed structure so that a vehicle impacting the cushion proximate the fixed structure will have a lesser chance of penetrating the cushion or contacting the fixed structure. These barrels are also surrounded by reinforcing structures which help redirect impacting vehicles back into the stream of traffic.

Also described is the use of a downstream base for the crash cushion which has chamfered or reduced upstream corners. The base is placed on the upstream side of the fixed structure if the fixed structure presents angular corners which might pose a coffin corner hazard to impacting vehicles. The base is preferably secured in place and includes preexisting cable anchor points.

9 Claims, 6 Drawing Sheets

U.S. PATENT DOCUMENTS

| | | | |
|---|---|---|---|
| 4,583,716 | 4/1986 | Stephens et al. | 256/13.1 |
| 4,815,565 | 3/1989 | Sicking et al. | 256/1 X |
| 4,934,661 | 6/1990 | Denman et al. | 256/13.1 |
| 5,011,326 | 4/1991 | Carney, III | 404/6 |
| 5,022,782 | 6/1991 | Gertz et al. | 404/6 |
| 5,217,318 | 6/1993 | Peppel | 404/6 |
| 5,248,129 | 9/1993 | Gertz | 256/13.1 |
| 5,314,261 | 5/1994 | Stephens | 256/13.1 X |
| 5,403,112 | 4/1995 | Carney, III | 256/13.1 X |
| 5,577,861 | 11/1996 | Oberth et al. | 256/13.1 X |
| 5,642,792 | 7/1997 | June | 256/13.1 X |
| 5,660,496 | 8/1997 | Muller et al. | 404/6 |

BARREL CRASH CUSHIONS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to crushable roadway crash cushions and, more specifically, those crash cushions which contain collapsible barrels, drums or like members.

2. Description of Related Art

A common highway crash cushion device is created by lining up a number of barrels which are formed of either metal or plastic. The lines of barrels are then positioned upstream of a fixed structure which is located in or adjacent to a roadway, the fixed structure representing a potential impact hazard to vehicles traveling along the roadway. The fixed structure is typically a concrete object, such as a bridge abutment or a median. In this discussion, the term "upstream" refers to the direction along the roadway from which traffic is expected to approach the fixed structure and, hence, is the direction from which a vehicle is most likely to impact the fixed structure. Conversely, "downstream" refers to the direction along the roadway which is generally opposite the upstream direction.

In conventional designs, barrels of a desired resistance to crushing are welded together at contact points and metal bands may be used to surround the barrels and band them together. Spacer bars or steel straps may also be tack welded to portions of the barrels. Screw eyes are screwed into the barrels so that wire rope or cables can be passed through the eyes and anchor the lines of barrels in position. It has also been known to place within the barrels a filler such as sand, sawdust and so forth, although normally the barrels remain unfilled. The barrels themselves are sometimes placed atop chair assemblies so that they remain above the ground. The upstream end of the lines of barrels is often covered by a reflectorized nose cover.

Some designs for barrel-filled crash cushions are described in U.S. Pat. No. 3,643,924, entitled "Highway Safety Device" issued to Fitch. Fitch shows a cushion formed of a group of barrels filled to varying degrees with sand.

One problem associated with conventional barrel cushions is their tendency to "pocket" at a critical impact point, thus causing the impacting vehicle to spin-out, creating a potential hazard to other traffic and failing to smoothly redirect the vehicle in a potentially controllable condition.

A further problem associated with the use of barrel crash cushions is that of "coffin corner" impacts. A coffin corner is a relatively angular portion of many fixed structures located near a roadway shielded by cushions. A gore wall, for example, usually presents two sharp (approximately 90°) lateral corners which pose particular hazards for impacting vehicles. Vehicles which impact a conventional crash cushion near the position where the cushion adjoins the gore wall may cause the cushion to pocket at that point and permit the vehicle to impact the coffin corner resulting in increased penetration within the vehicle and high levels of deceleration.

A third, related problem associated with conventional barrel cushion design stems from the fact that the barrel cushion is primarily designed to cushion only impacts resulting from vehicles which approach the fixed structure from substantially the upstream direction. The cushions do not adequately cushion or smoothly redirect those vehicles which occasionally strike the cushion from the downstream direction or a direction other than primarily upstream. Because the lines of barrels in a typical conventional crash cushion are relatively thin (2–3 barrels in width), a vehicle may tear completely through the cushion after striking the side of the cushion. Widening the cushion appreciably by adding additional lines of barrels may be impractical in some situations, such as when the cushion is located on a narrow median strip.

Although there have been some design changes proposed in the past for barrel-type crash cushions, these modifications would not address all or most of the problems inherent in the design.

U.S. Pat. No. 3,845,936, issued to Boedecker, Jr. et al., for example, shows a modular crash cushion in which a series of overlapping sheet-like "fish scales" are affixed along the longitudinal sides of the barrel cushion to help divert a vehicle upon impact with the side of the crash cushion. Each of the fish scales is constructed of a plywood sheet and a painted metal sheet. Unfortunately, fish scales of this type do not properly redirect vehicles which impact the cushion from the downstream direction or a direction resulting in an impact which is other than substantially end-on. To this extent, the crash barrier is, at best, unidirectionally redirective, or redirective of impacts approaching from one direction—from substantially upstream. Further, the fish scales may themselves present a hazard to an impacting vehicle by causing it to become hung up on or be pierced by the sharp edges of the scales. Therefore, these types of barriers are not be suitable in situations where traffic passes by the cushion in two directions.

U.S. Pat. No. 4,583,716, issued to Stephens et al. describes an anchoring system in which buffer elements are positioned in an ordered array extending forwardly of a rigid backing member adjacent to a fixed structure. Diaphragm members are disposed in the array and extend laterally outward of the array at fixed intervals. Fender panels are pivotally coupled to opposed ends of the diaphragm members and extend rearwardly from their associated diaphragm members to partially overlap the fender panels coupled to succeeding diaphragm members. When this type of cushion is impacted from an end-on direction, the fender panels swing outwardly on their pivotal connections. Like those of the fish scales, the edges of the fender panels present a potential hazard for vehicles impacting the cushion from a direction other than substantially end-on.

Because of the problems with pocketing, coffin corner impacts, and non-end-on impacts, conventional barrel cushion designs will not meet new highway safety standards for the year 1998. Existing standards; Under National Cooperative Highway Research Program (NCHRP) Report 230, a typical barrel crash cushion is considered to be a non-redirective crash cushion. A redirective cushion or barrier is one which is substantially not penetrated by the vehicle and which acts to redirect the vehicle back into the flow of traffic. The impact performance requirements and, hence, the capabilities, of a nonredirective crash cushion are considerably less than those for a redirective crash cushion. A redirective crash cushion is subjected to more tests, and the requirements of those tests are more rigorous. A new standard, known as NCHRP Report 350, is expected to become effective on Sep. 1, 1998 and adopts more stringent requirements for such crash barriers.

A further drawback to conventional designs for barrel cushions is that the barrels and their metal banding connections are themselves unprotected and exposed to the impacts from vehicles. Thus, the connections may be broken and barrels nearest the roadway destroyed or damaged in light "brush by" collisions in which the cushion is not collapsed by the impact. "Brush by" collisions of this nature, therefore, require maintenance and repair of the cushion.

The present invention is directed to reducing the problems associated with prior art systems.

SUMMARY OF THE INVENTION

The present invention offers improved barrel crash cushions which readily collapse when impacted from a substantially end-on direction, but are more capable than conventional designs of substantially redirecting vehicles impacting from non-end-on directions reducing the chance of these vehicles tearing through the crash cushion. The invention is further directed toward the use of barrel crash cushion configurations which substantially reduce the harm associated with "coffin corner" impacts. The cushions described herein also reduce the maintenance required as a result of "brush by" impacts.

Improved crash cushions are described which use a structurally reinforced portion to increase the ability of the crash cushion to withstand impacts from directions other than substantially end-on. In some exemplary embodiments, the bracing arrangement is provided by a telescoping pipe assembly which surrounds some of the barrels of the crash cushion. In another exemplary embodiment, the reinforcement is provided by a plurality of interconnected cable sleeves which are carried on cables to create a linear brace along the longitudinal sides of the crash cushion. In other embodiments of the invention, a barrel crash cushion is constructed using barrels having differing resistances to crushing. The barrels having the greatest resistance to crushing are placed along the longitudinal sides of the cushion close to the fixed structure so that a vehicle impacting the cushion proximate the fixed structure will have a lesser chance of penetrating the cushion or contacting the fixed structure. These barrels are surrounded by reinforcing structures which assist in redirecting impacting vehicles back into the flow of traffic.

Also described is the use of a downstream base for the crash cushion which has chamfered or reduced upstream corners. The base is placed on the upstream side of the fixed structure if the fixed structure presents angular corners which might pose a coffin corner hazard to impacting vehicles. The base is preferably secured in place and includes preexisting cable anchor points.

DETAILED DESCRIPTION OF THE PREFERRED EMBODIMENTS

Figure 1:
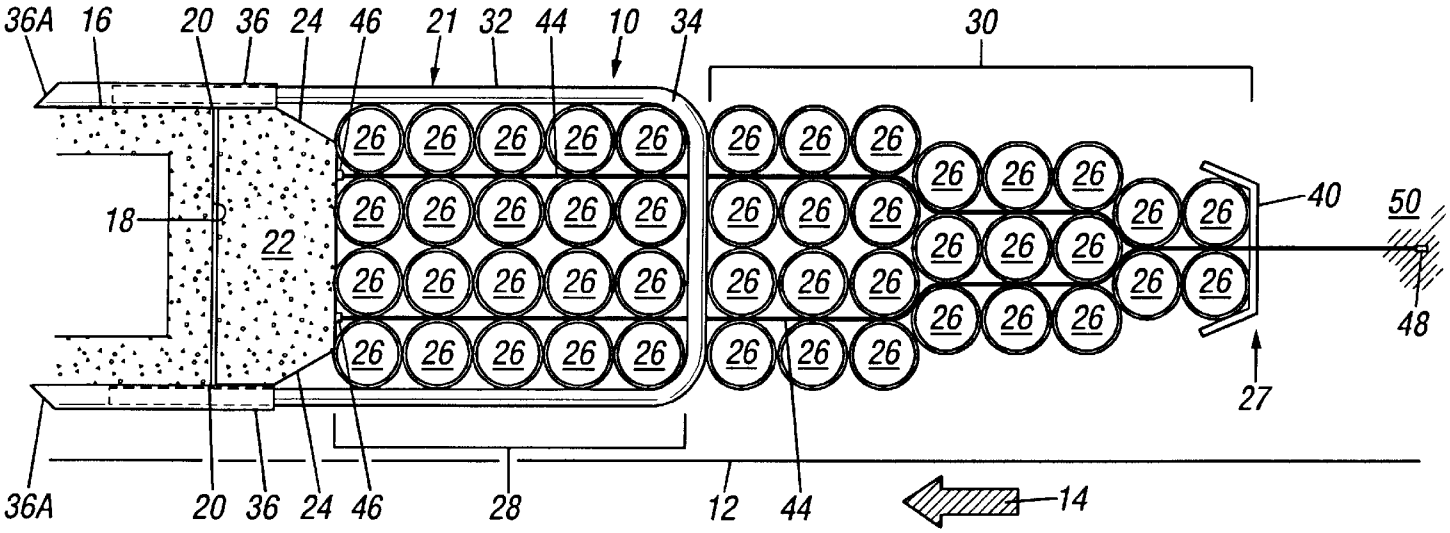
FIG. 1 is a plan view of a first exemplary embodiment of a barrel crash cushion constructed in accordance with the present invention in which a piping segment surrounds a group of barrels.

In accordance with the present invention, barrel crash cushions are fashioned to more readily redirect impacting vehicles and to more uniformly distributing the load of an impact over among the several barrels of the group or among adjacent barrels. Additionally, the configurations described herein substantially reduce the harm associated with coffin corner impacts and impacts from a non-end-on direction. In another aspect of the present invention, the cushions are strengthened proximate the fixed object to which it is proximate. The methods and apparatus of the present invention also permit a previously non-redirective or unidirectional redirective roadway cushion to be substantially redirective.

In the following discussion, identical or similar components among the various embodiments will be designated by like reference numerals.

Figure 2:
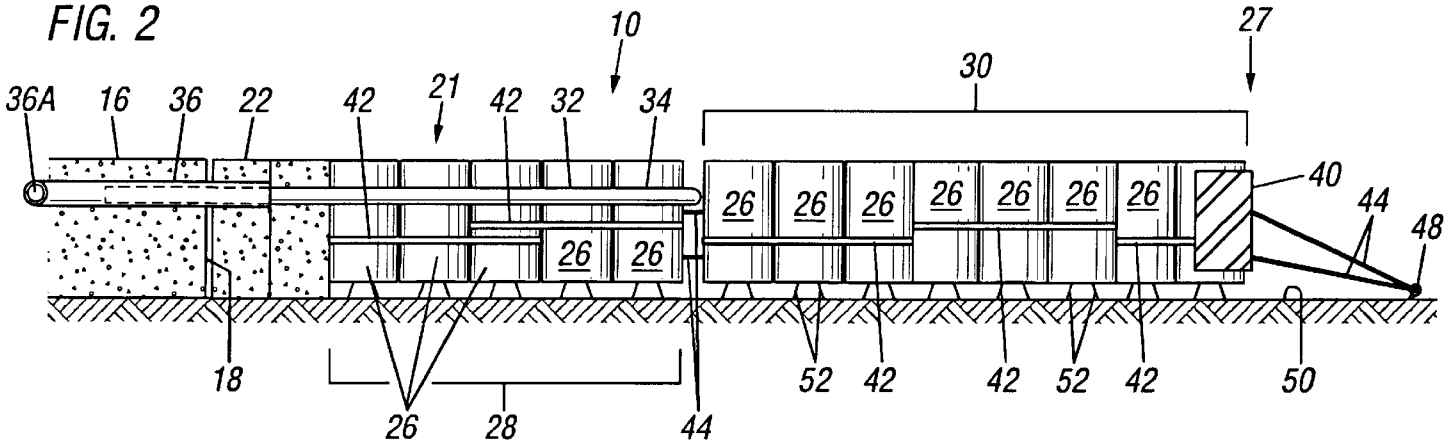
FIG. 2 is a side view of the barrel crash cushion shown in FIG. 1.

Referring first to FIGS. 1 and 2, a first exemplary roadway hazard safety device 10 is depicted. The safety device 10 is located alongside a roadway, the edge of which is shown at 12. Traffic along the roadway 12 moves in the direction of arrow 14. Hence, vehicles approaching the fixed structure 16 in the direction of the arrow 14 are approaching from the upstream direction.

The safety device 10 includes a roadway fixed structure 16 which may be a median, right road shoulder or a gore wall located at the divergence of two roads, such as where an exit departs a main highway. The fixed structure 16 might also comprise other highway appurtenances, such as a bridge abutment. The fixed structure 16 presents a contact wall 18 into which a vehicle which impacts the fixed structure 16 might be expected to collide if it were traveling in the direction of arrow 14 and then strayed from the roadway 12 and if the fixed structure 16 were unprotected. The fixed structure 16 also presents sharpened corners 20 which are corners having approximately a 90° angle.

A barrel crash cushion 21 is positioned adjacent to the fixed structure 16, preferably between the fixed structure 16 against the direction of expected approach 14 for an impacting vehicle. The barrel crash cushion 21 includes a downstream base 22 which is positioned upstream of the contact wall 18. The base 22 includes chamfered corners 24 so that a sharp angle of concrete or steel is not presented which could form a hazard for an impacting vehicle. The downstream base 22 is preferably affixed to the fixed structure 16 or is anchored to the surface 50 to secure the base 22 in position.

The crash cushion 21 also includes a plurality of collapsible members 26, such as barrels, which are arrayed within the crash cushion 21. It is noted that, while the objects most commonly used today as such collapsible members are plastic or metal barrels, other collapsible objects might also be used. The barrels 26 are arranged to generally extend from the downstream base 22 to an upstream end 27. Thus arranged, the barrels 26 of the crash cushion 21 present two longitudinal sides which extend between the downstream base 22 and the upstream end 27. FIG. 2 presents a view of one of the longitudinal sides of crash cushion 21.

The crash cushion 21 includes a first barrel group 28 which is located closest to the fixed structure 16 and a second barrel group 30, which is located further from the fixed structure 16. The first barrel group 28 consists of four rows of barrels which extend upstream from the base 22 in the direction of the upstream end 27. The first barrel group 28 is enclosed on three sides by a telescoping bracket assembly 32 which serves to maintain the barrels 26 of the first barrel group 28 in alignment and also to prevent pocketing from occurring near the base 22 and the fixed structure 16.

The telescoping bracket assembly 32 is collapsible without performing an energy absorbing function. The bracket assembly 32 is preferably formed of a U-shaped section of pipe 34 and a pair of supporting sleeves 36. A presently preferred U-shaped pipe section 34 has a 4" outer diameter. The sleeves 36 should be sized to present a sufficiently large cross-sectional diameter so that the pipe section 34 nests within the sleeves 36 and is readily slidable therethrough without being excessively snug or resulting in significant friction between the pipe section 34 and the sleeves 36 when these components are moved with respect to one another. The sleeves 36 are preferably provided with a downstream end 36A which is cutaway at an angle which is less than 90° so that a sharp outer corner is not presented upon which an impacting vehicle might potentially become snagged. It is currently preferred that the telescoping bracket assembly 32 enclose a number of rows of barrels 26. The sleeves 36 are securely anchored to the downstream base 22. Preferably, this anchoring is done as the base 22 is cast or prior to the time when the base 22 is placed upstream of contact wall 18.

The second group of barrels 30 is not enclosed by the telescoping bracket assembly 32 and tapers in the upstream direction toward a pair of lead barrels which are covered by a reflectorized nose piece 40. Metal banding 42 (see FIG. 2) is used to affix the barrels 26 and sections of barrels to one another. Typical metal banding entails encircling the circumference of two or more barrels with galvanized steel metal banding material, or a suitable substitute, and affixing the ends of the banding material with banding clips. The use of metal banding 42 is well-known in the art. Bracket members (not shown) are also known in the art and may be used to locate the barrels 26 at fixed distances from one another. It is pointed out that welding of the barrels 26 may be used in addition to, or even in place of, the metal banding to assist in affixing the barrels 26 to one another.

A number of cables or wire ropes 44 extend from cable anchors 46 affixed within the base 22 to a cable anchor 48 affixed within the surface of the earth 50 at a point forward of the reflectorized nose cover 40. There are generally two pairs of cables 44 used. The cables 44 are passed by the barrels 26 and through wire rope clips and pad eye cable supports (not shown) in a manner known in the art in order to anchor the various barrels 26 to the surface 50. The U-shaped pipe segment 34 rests atop the upper pair of cables 44, as depicted in FIG. 2. The cables 44 generally extend along the inner sides of the longitudinally outer lines of barrels 26. The barrels 26 are preferably supported above the ground 50 by chair assemblies (52 in FIG. 2) which will permit drainage beneath the barrels 26.

Figure 3:
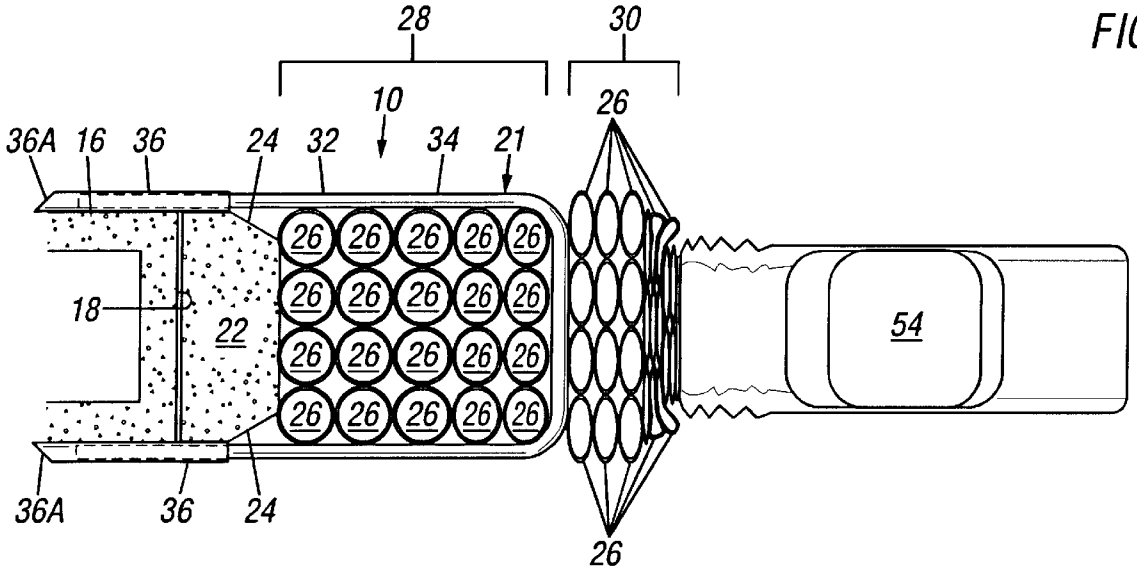
FIG. 3 is a plan view of the crash cushion depicted in FIGS. 1 and 2 following a substantially end-on impact with a vehicle.

During an impact from substantially end-on, the barrel cushion 21 of the safety device 10 readily collapses to absorb the energy of the collision. FIG. 3 depicts a vehicle 54 which has approached fixed structure 16 from the upstream direction, as indicated by arrow 14 in FIG. 1, and has impacted the safety device 10 from end-on. The barrels 26 in the second barrel group 30 are crushed. The telescoping bracket assembly 32 is displaced in the downstream direction as the impact causes the U-shaped pipe segment 34 to be slidably disposed through the sleeves 36 in a telescoping manner. As a result of the telescoping displacement of the bracket assembly 32, the barrels 26 in the first barrel group 28 are also crushed to some extent.

Figure 4:
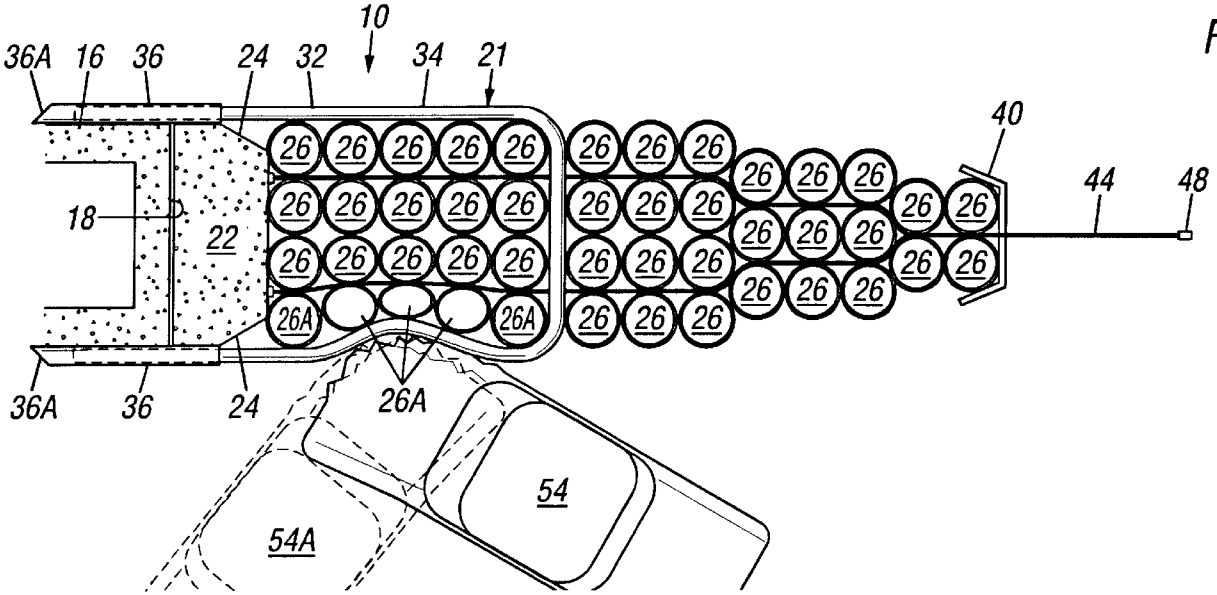
FIG. 4 is a plan view of the crash cushion depicted in FIGS. 1 and 2 following an impact with a vehicle from other than a substantially end-on direction.

Referring now to FIG. 4, a vehicular impact from a direction other than substantially end-on is depicted. Vehicle 54 has in this case, approached the safety device 10 from a side angle rather than substantially from the upstream direction and has struck the crash cushion 21 along one of its longitudinal sides as shown. The vehicle 54 impacts the cushion 21 along the side of the bracket assembly 32. The U-shaped pipe segment 34 deflects to a limited degree in response to the impact load. The U-shaped pipe segment 34 further transmits this loading to the plurality of barrels which it contacts which are designated in FIG. 4 as barrels 26A. The presence of the pipe segment 34 structurally reinforces the crash cushion 21 against side impacts such as the one illustrated in FIG. 4.

It is further noted that virtually the same result would obtain if the vehicle had impacted the crash cushion 21 from substantially the opposite direction from vehicle 54. Reference numeral 54A shows, in phantom, a vehicle which has impacted the crash cushion 21 from a direction substantially opposite from that of vehicle 54 in FIG. 4. Again, the pipe segment 34 deflects to only a limited degree and transmits the impact load to the barrels by spreading it among a plurality of barrels 26A while the vehicle is smoothly redirected back into the traffic stream.

Figure 5:
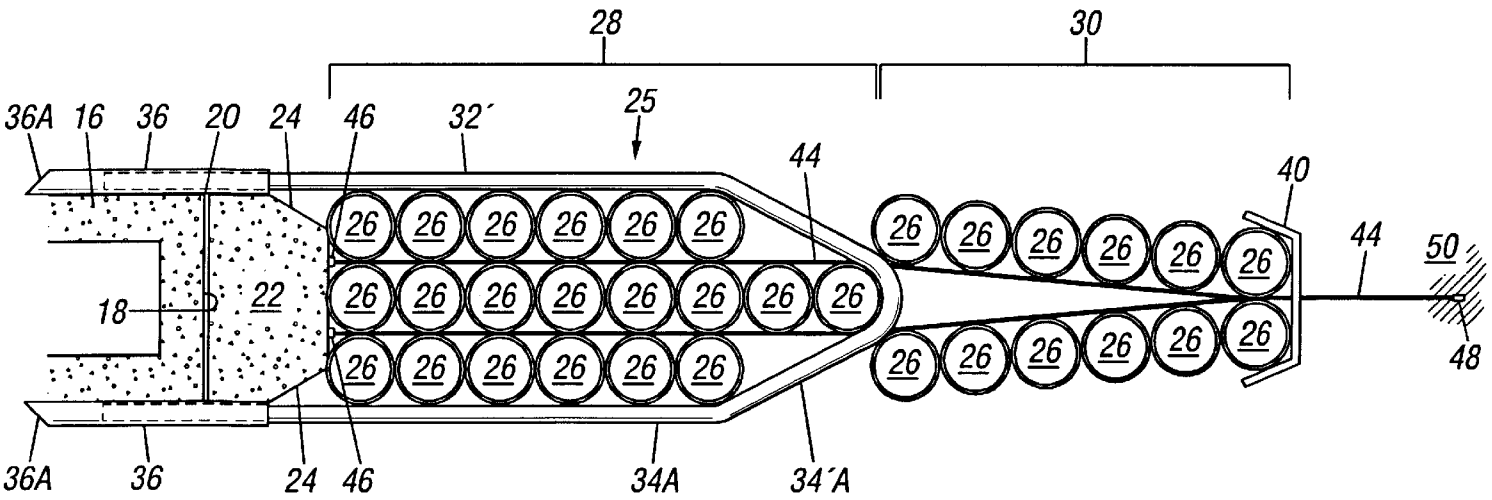
FIG. 5 is a plan view of a second exemplary embodiment of a barrel crash cushion constructed in accordance with the present invention.

Referring now to FIG. 5, a second exemplary embodiment of the invention is shown. A crash cushion 25 is shown which has a fewer number of barrels 26 than crash cushion 10. Only three rows of barrels 26 are provided in the first group of barrels 28, rather than four. The crash cushion 25 features a bracket assembly 32' in which the inner pipe segment 34' has a V-shaped upstream portion 34'A rather than being U-shaped. This design permits the cables 44 to be drawn more tautly.

Figure 6:
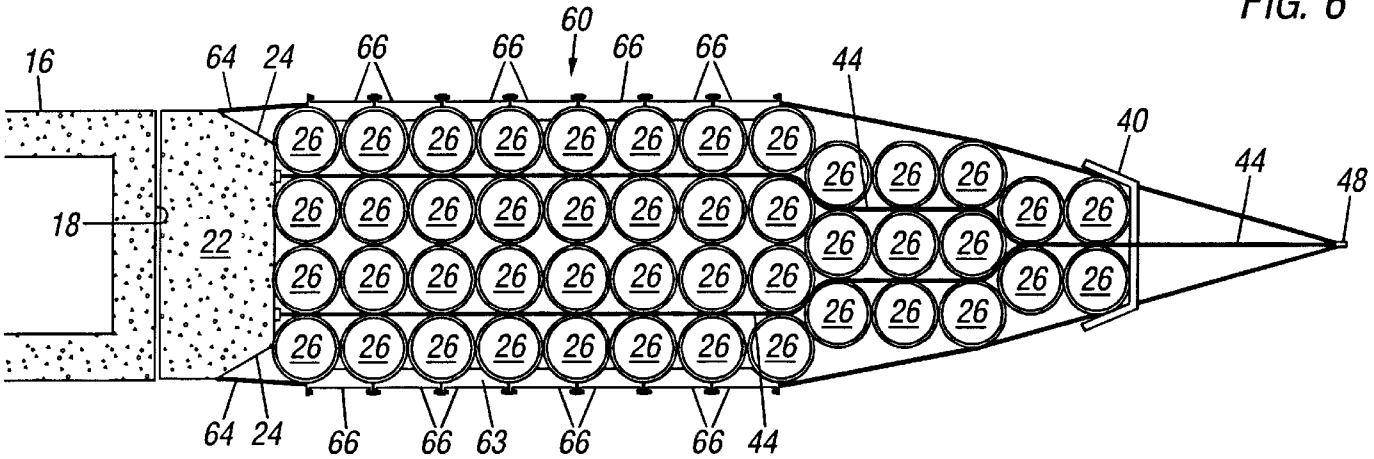
FIG. 6 is a plan view of a third exemplary embodiment of a barrel crash cushion constructed in accordance with the present invention.
Figure 7:
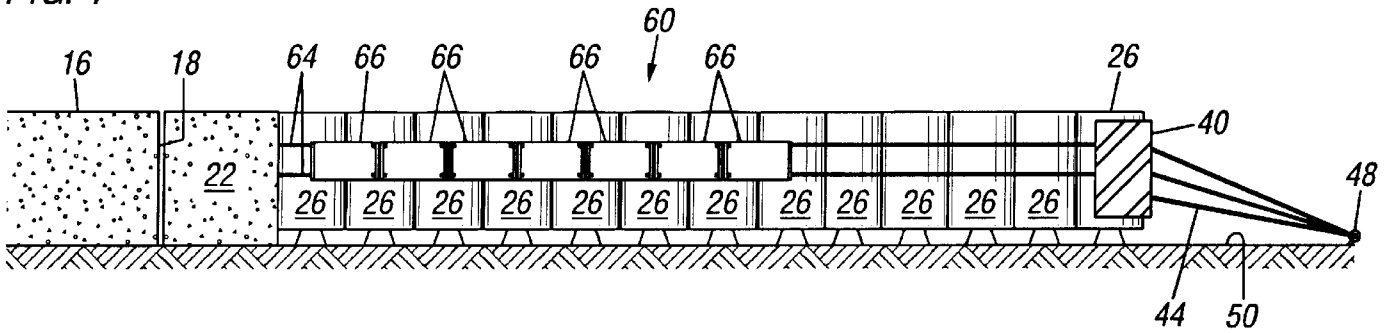
FIG. 7 is a side view of the barrel crash cushion shown in FIG. 6.
Figure 9:
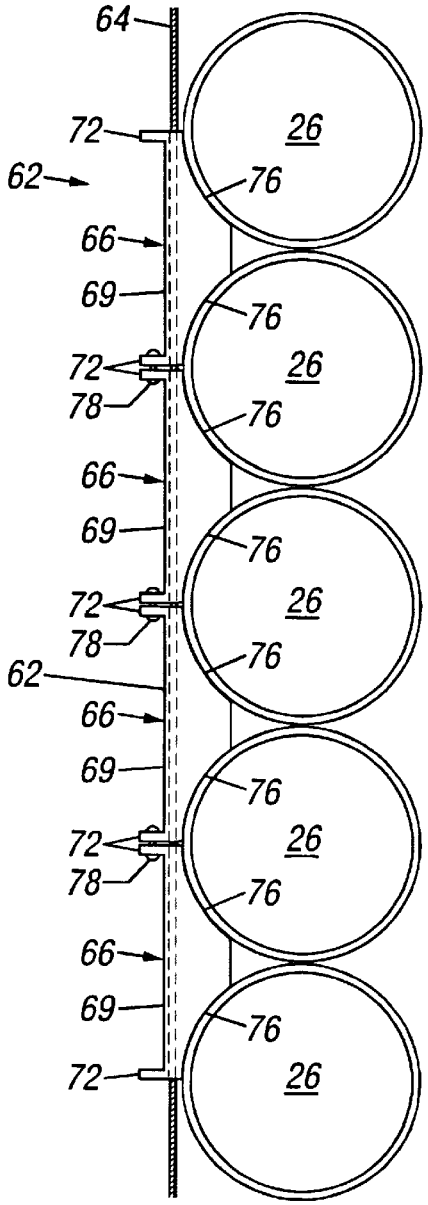
FIG. 9 is a detail depicting a number of the cable sleeves shown in FIG. 8 interconnected along the side of a barrel crash cushion.
Figure 9A:
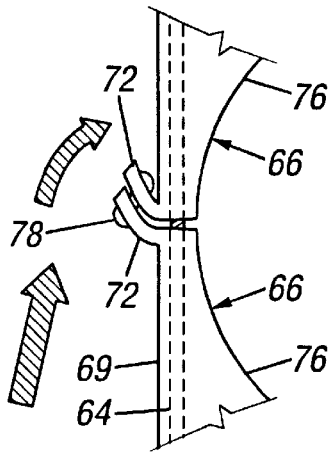
FIGS. 9A and 9B are additional details relating to the cable sleeves of FIGS. 8 and 9.
Figure 9B:
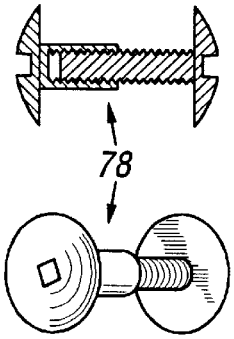
Figure 8:
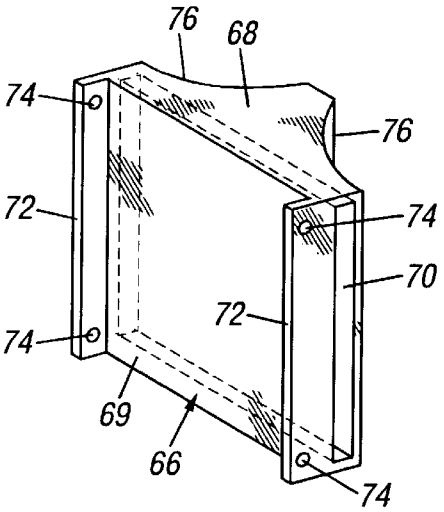
FIG. 8 is a detail of one of the cable sleeves used with the crash cushion shown in FIG. 6.

Referring now to FIGS. 6 and 7, a third exemplary embodiment of the invention is depicted in which the longitudinal sides of a crash cushion 60 are reinforced using linear braces 62 which are disposed along the longitudinal sides of the cushion 60. The linear braces 62 include a pair of cables 64 which are anchored to either side of the downstream base 22 using standard anchor assemblies (not shown). The cables 64 extend along the longitudinal sides of the cushion 60 and are affixed to the ground 50 at anchor point 48. The lateral braces 62 also include linear struts 63 which are formed in this instance by a plurality of interconnected cable sleeves 66 formed of a sturdy and durable material such as steel so that they will withstand impacts from a vehicle without being destroyed. The cable sleeves 66 are depicted in greater detail in FIGS. 8, 9, 9A and 9B. As best shown in FIG. 8, an individual cable sleeve 66 is formed of a solid housing 68 through which is disposed a longitudinal cable passage 70. The housing 68 presents an impact surface 69 from which a pair of flanges 72 project. The projecting flanges 72 each include bolt holes 74 disposed therethrough. On the opposite side of the housing 68 from the flanges 72, a pair of outwardly curved surfaces 76 are presented. FIG. 9A depicts interconnection of a number of cable sleeves 66 and their placement upon a cable 64 to form a lateral brace 62. Round-headed bolt-and-nut assemblies 78 are placed through the bolt holes 74 to interconnect the flanges 72 of adjoining cable sleeves 72. Two forms for preferred bolt-and-nut assemblies 78 are depicted in FIG. 9B. When the cable sleeves 66 are secured to one another in this manner, they form a substantially rigid brace assembly.

When assembled in this manner, the lateral brace 62 is placed adjacent barrels 26 so that the curved surfaces 76 of the cable sleeves 66 adjoin and contact the curved outer surface of the barrels 26. As FIG. 9 illustrates, each of the cable sleeves 66 adjoins and contacts two barrels 26. When a load is applied to the impact surface 69 of a cable sleeve 66, the load will be distributed to each of the two barrels 26 which are contacted by that cable sleeve. The flanges 72 of the cable sleeves 66 are intended to bend laterally when impacted by a vehicle, as illustrated in FIG. 9A.

The crash cushion 60 will readily collapse when impacted from end on. However, the presence of the lateral braces 66 increases the cushion's resistance to penetration and pocketing from impacts occurring from or along the longitudinal sides of the cushion 60.

Figure 10:
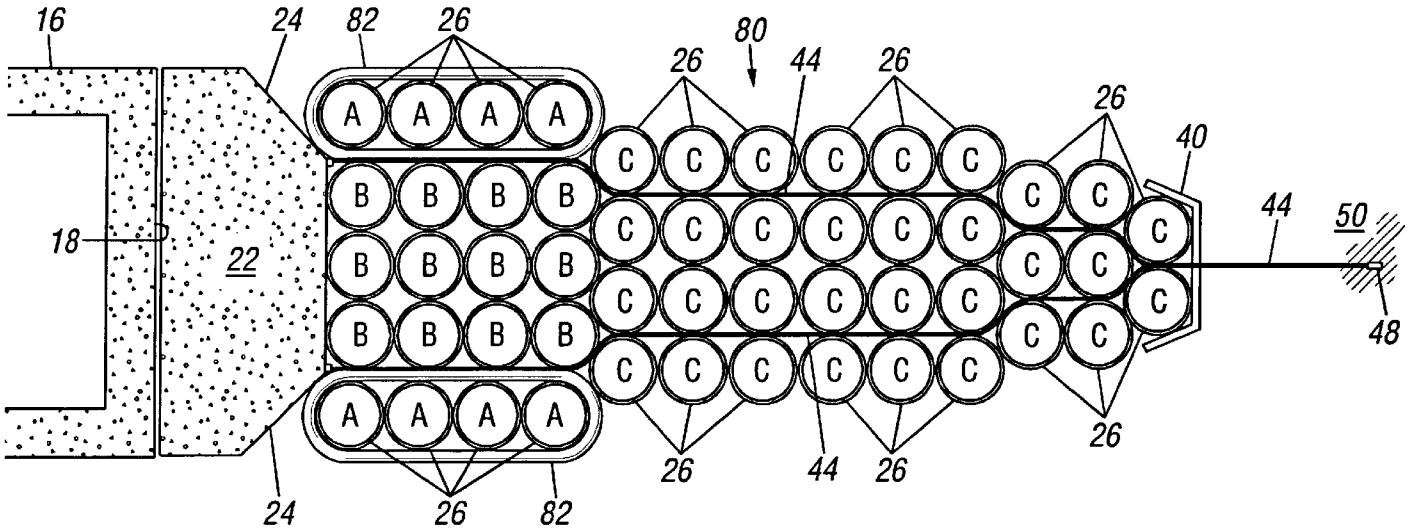
FIG. 10 is a plan view of a fourth exemplary embodiment of a barrel crash cushion constructed in accordance with the present invention.

Referring now to FIG. 10, a fourth embodiment is depicted in which a crash cushion 80 has been constructed utilizing barrels 26 which have differing resistances to crushing. A first set of barrels 26 is identified in FIG. 10 by each of the barrels 26 containing the letter A. A second set of barrels is identified with the letter B, and a third set of barrels is identified with the letter C. Barrels of differing resistances to crushing are available commercially from Greif Brothers Corporation of Delaware, Ohio. Resistance to crushing is altered by the placement of holes, semicircular cuts, or other perforations in the end membranes (i.e., the top and bottom) of the barrels. The barrels 26 identified with the letter A have a greater resistance to crushing than the barrels 26 identified with the letter B. Also, barrels 26 identified with the letter B have a greater resistance to crushing than the barrels 26 having identified with the letter C. It is contemplated that the preferred range of dynamic crushing strength for "A" barrels is 20–30 kips. The preferred range of dynamic crushing strength for "B" barrels is 10–15 kips. The preferred range of dynamic crushing strength for "C" barrels is 5–10 kips.

The position of the barrels 26 of the "A," "B" and "C" variety within the cushion 80 results in a cushion which will readily collapse when impacted from end on but be less vulnerable to penetration and pocketing when impacted along the longitudinal sides proximate the downstream base 22.

A pair of reinforcing loops 82 are extended about the perimeter of "A" barrels to further reinforce the "A" barrels against an impact. The reinforcing loops 82 also serve the purpose of securing several of the barrels 26 together into a unit so that during an impact, the chances of pocketing occurring is reduced. The reinforcing loops 82 are preferably formed of 4" O.D. pipe which has been bent into a loop that will fit around the outer boundaries of several barrels. The reinforcing loops 82 are each secured to a cable assembly 44 as shown so that they are maintained above the ground 50 at the approximate height of the cables 44 and are capable of sliding along the cables 44 in either an upstream or downstream direction.

During an end-on impact from substantially the upstream end of the barrier 80, the reinforcing loops 82 and the barrels 26 within them will tend to be deflected outwardly by the chamfered sides 24 positioning the barrels 26 and loops 82 upstream of the sides 24.

Figure 11:
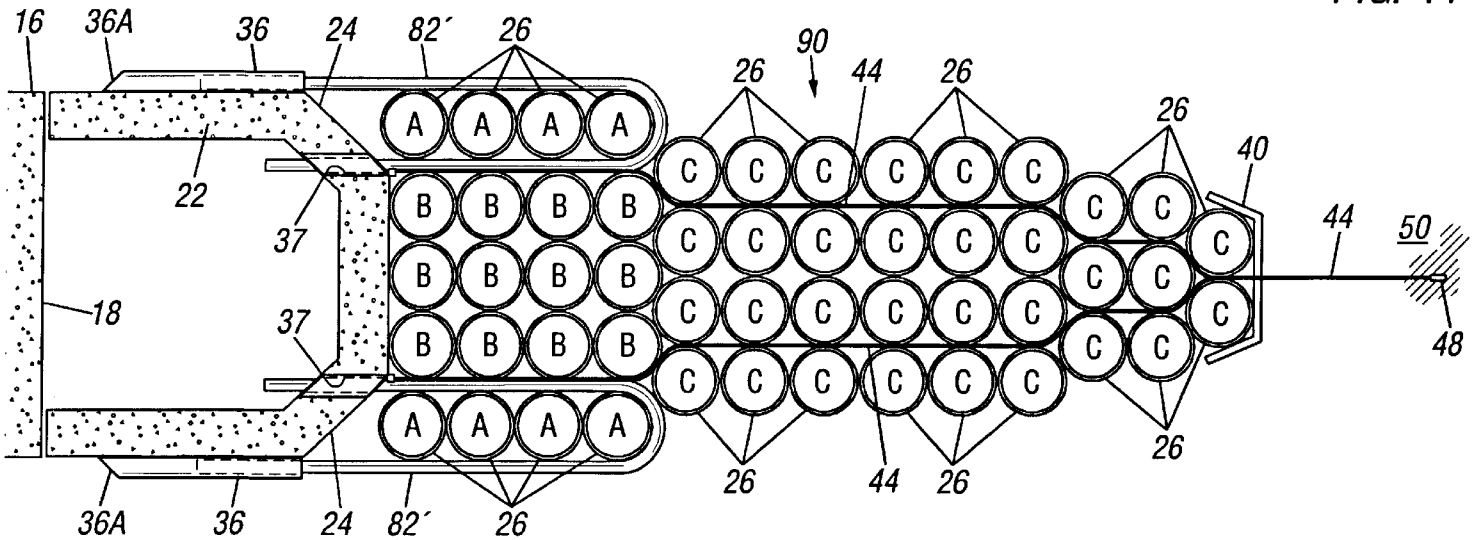
FIG. 11 is a plan view of a fifth exemplary embodiment of a barrel crash cushion constructed in accordance with the present invention.

Referring now to FIG. 11, a fifth exemplary embodiment of the invention is now described. A crash cushion 90 is depicted which is constructed similarly to the crash cushion 80 of FIG. 10 in many respects. However, the reinforcing loops 82' are substantially U-shaped members which are disposed within outer support sleeves 36 and inner support sleeves 37. The inner support sleeves 37, in the same manner as the supporting sleeves 36, are formed of a pipe of larger diameter than that of the loops 82'. Unlike the outer support sleeves 36, the inner support sleeves 37 are actually disposed through the base 22.

During an end-on impact from substantially the upstream direction, the reinforcing loops 82' will tend to be slidingly disposed in a downstream direction within the support sleeves 36 and 37 in a telescoping manner similar to that described for the bracket assemblies 32, 32' previously described permitting the barrels 26 within to be crushed. During an impact from the lateral side of the cushion 90, however, the loops 82' and barrels within form a reinforced portion which prevents the impacting vehicle from tearing through the cushion 90.

Construction of a crash cushion in accordance with the present invention may be accomplished through either constructing a new crash cushion in accordance with the configurations taught herein or by suitably retrofitting an existing conventional crash cushion to provide for structural reinforcement of the sides of the barrier proximate the downstream end of the barrier.

It should be understood that while the invention has been herein shown and described in what is presently believed to be the most practical and preferred embodiment thereof, it will be apparent to those skilled in the art that many modifications may be made to the invention described while remaining within the scope of the claims.

What is claimed is:

1. A roadway crash cushioning apparatus to cushion impacts with a fixed structure proximate a roadway, the crash cushioning apparatus comprising:

(a) a plurality of collapsible barrels having top and bottom membranes, the barrels extending between a downstream end and an upstream end and presenting a longitudinal side; and (b) a structural reinforcement along a portion of the longitudinal side to significantly reduce penetration of the collapsible barrels from an impact to the longitudinal side, the structural reinforcement comprising a telescoping bracket assembly which surrounds at least one of said collapsible barrels.

2. The cushioning apparatus of claim 1 wherein the telescoping bracket assembly comprises a generally U-shaped section of pipe nested within a sleeve.

3. The cushioning apparatus of claim 1 wherein the telescoping bracket assembly comprises a generally V-shaped section of pipe nested within a sleeve.

4. A crash cushioning apparatus to cushion impacts with a fixed structure proximate a roadway, the cushioning apparatus having a plurality of collapsible members and comprising:

(a) a first collapsible member having a first resistance to crushing;

(b) a second collapsible member having a second resistance to crushing, the second resistance being lesser than the first resistance;

(c) the first collapsible member being located along a longitudinal side of the cushioning apparatus; and (d) said first collapsible member being surrounded by a reinforcing structure, and the second collapsible member not being surrounded by a reinforcing structure.

5. The crash cushioning apparatus of claim 4 further comprising a third collapsible member having a third resistance to crushing which is lesser than the second resistance.

6. The crash cushioning apparatus of claim 4 wherein said collapsible members comprise barrels.

7. A roadway crash cushioning apparatus to cushion impacts with a fixed structure proximate a roadway, the crash cushioning apparatus comprising:

(a) a plurality of collapsible members extending between a downstream end and an upstream end and presenting a longitudinal side;

(b) a structural reinforcement along a portion of the longitudinal side to significantly reduce penetration of the collapsible members from an impact to the longitudinal side, the structural reinforcement comprising a lateral brace which is disposed along said longitudinal side, the lateral brace comprising:

(1) a cable extending along the longitudinal side; and (2) a rigid linear strut carried on said cable, said strut comprised of a plurality of interconnected cable sleeves, each of said cable sleeves presenting a pair of curved surfaces, each of said surfaces adjoining a collapsible member and adapted to transmits impact load to said collapsible member.

8. The cushioning apparatus of claim 7 further comprising a downstream base formed of concrete.

9. The cushioning apparatus of claim 7 wherein the collapsible members comprise barrels.

* * * * *